US006062055A

United States Patent [19]

Bobig et al.

[11] Patent Number: 6,062,055

[45] Date of Patent: May 16, 2000

[54] ROLLING METHOD FOR THIN FLAT PRODUCTS AND RELATIVE ROLLING LINE

[75] Inventors: Paolo Bobig, San Canzian D'Isonzo; Bruno Di Giusto, Udine, both of Italy

[73] Assignee: Danieli & C. Officine Meccaniche SpA, Udine, Italy

[21] Appl. No.: 09/015,323

[22] Filed: Jan. 29, 1998

[30] Foreign Application Priority Data

Apr. 10, 1997 [IT] Italy ..... UD97A0063

[51] Int. Cl.[7] ..... B21B 27/06

[52] U.S. Cl. ..... 72/201; 72/200; 72/202

[58] Field of Search ..... 72/200, 201, 202, 72/229, 234, 227, 226, 203, 366.2, 235, 129, 130, 132

[56] References Cited

U.S. PATENT DOCUMENTS

| | | | |
|---|---|---|---|
| 3,851,510 | 12/1974 | Reth | 72/234 |
| 3,905,216 | 9/1975 | Hinrichsen | 72/201 |
| 5,085,066 | 2/1992 | Komami et al. | 72/201 |
| 5,743,125 | 4/1998 | Kneppe et al. | 72/201 |
| 5,802,902 | 9/1998 | Rosethal et al. | 72/201 |

FOREIGN PATENT DOCUMENTS

| | | |
|---|---|---|
| 226446 | 6/1987 | European Pat. Off. . |
| 595282 | 5/1994 | European Pat. Off. . |
| 761325 | 3/1997 | European Pat. Off. . |
| 761326 | 3/1997 | European Pat. Off. . |
| 771596 | 5/1997 | European Pat. Off. . |
| 9701401 | 1/1997 | WIPO . |
| 9746332 | 12/1997 | WIPO . |

OTHER PUBLICATIONS

Schoenbech, J. et al, "Stand Der ISP–Technologies Und Neue Entwicklungen" Stahl Und Eisen, vol. 116, No. 11, Nov. 11, 1996, pp. 65–73, 158.

McManus G J: "Ferritic Rolling Of Hot Rolled Sheet: Successful Use Of New Technology Could Open Doors" Iron and Steel Engineer, vol. 72, No. 8, Aug. 995 pp 53/54.

*Primary Examiner*—Rodney A. Butler

*Attorney, Agent, or Firm*—Antonelli, Terry, Stout & Kraus, LLP

[57] ABSTRACT

Rolling method for thin flat products, used in the production of flat rolled products with a final thickness in the range of 0.6–1.5 mm or more, up to 2.0–3.0 mm, in a plant suitable to work thicknesses of up to 25.4 mm, the method being applied to slabs with a thickness of between 50 and 90 mm if arriving directly from the continuous casting machine or on slabs with a greater thickness, of between 80 and 200–250 mm, if fed from a furnace to accumulate and heat the slabs (22), the method comprising at least a first heat treatment, a roughing or pre-finishing pass, a temperature equalisation treatment and a finishing pass in a finishing train (19) comprising at least three reduction passes, the finishing pass being followed by a step of cooling and coiling the flat finished product, the product at the outlet of the roughing or pre-finishing pass being in the austenitic state γ, the finishing pass taking place in the rolling line (10) at least partly in the ferritic step or in the austenitic step, as desired. Rolling line adopting the method as above, wherein the finishing train (19) cooperates with a system (24) to condition and adjust the temperature of the slab.

26 Claims, 2 Drawing Sheets

ROLLING METHOD FOR THIN FLAT PRODUCTS AND RELATIVE ROLLING LINE

BACKGROUND OF THE INVENTION

This invention concerns a rolling method for thin flat products, and the relative rolling line.

The invention is applied in the field of flat rolled stock, such as strip or sheet, and more particularly to obtain thin final products, around 1.5–3.0 mm, and very thin, less than 1 mm, to as little as 0.6–0.7 mm.

The state of the art includes rolling lines for flat rolled products, both of the traditional type, where the furnace to heat the slabs is separated from the casting machine and connected to the rolling train, and also the type where the rolling train is directly connected to the continuous casting machine.

The standard configuration of these rolling lines generally comprises, downstream of the continuous casting machine and the shears, a temperature-maintaining and possibly a temperature-restoring system, a roughing train comprising a number of stands which is normally between one and three, a temperature maintaining and equalisation system and the finishing train, normally comprising between four and ten stands, followed by a cooling system and a coiler to form the coil of rolled product.

Apart from these basic components of the line, normally there are also fast heating devices, for example induction furnaces, scaling devices at the outlet and/or inlet of the temperature restoring systems, devices to heat the edges, emergency shears, intermediate coilers, devices to measure the size and other operative and/or conditioning assemblies which are known to the state of the art and are widely known to those skilled in this field.

In the field of flat rolled products, obtaining strip or sheet with a final thickness of around 1.0–1.5 mm has been widely explored and the results obtained, in terms of the quality of the finished product, can be considered substantially satisfactory.

It should be considered that at the inlet to the finishing train there are usually temperature equalisation and temperature restoration systems by means of which it is possible to determine extremely rigorous and precise conditions of the product; this guarantees that at least the first passes to reduce the thickness can be carried out in the best possible rolling conditions, for example with the product in the austenitic state $\gamma$ and in heat conditions far removed from the allotropic transformation step from the austenitic state $\gamma$ to the ferritic state $\alpha$.

This requirement derives from the need to maintain constant values of rolling force and rolling torque in order to have a constant behaviour of the rolling stands, so that the quality of the rolled product is constant.

However, there is a tendency in the markets at present to demand ever thinner final products, less than 1.0 mm, to 0.6–0.7 mm and even less, or for products of conventional thickness, for example in the range of 1.5–3.0 mm, but with special mechanical and metallurgical characteristics.

Rolling ultra-thin products has demonstrated problems and disadvantages which had never been thought of before, which in conventional rolling lines of the type described above have a considerable impact on the surface and internal dimensional quality (thickness, profile and planarity) of the finished product.

To be more exact, it has been found that the final reducing passes of the finishing train, which obtain this kind of reduced thicknesses, are performed on a product which, in the final rolling stands, is in a condition of allotropic transformation from the austenitic state $\gamma$ to the ferritic state $\alpha$.

The temperature at which this transformation takes place depends mainly on the composition of the steel being worked and particularly on the percentage of carbon therein, the speed of cooling and the sequence of reduction of the thickness.

In the most frequent cases found in practice, that is, in steels with a low carbon content, the temperature at which the allotropic transformation begins is around 800–880° C. It is highly inadvisable therefore to carry out rolling operations at such a temperature, when the product is in the process of changing from state $\gamma$ to state $\alpha$.

This is because the lack of structural homogeneity of the product, also due to the fact that it is very thin, leads to a product being obtained which is inferior in both surface and internal quality, with insufficient planarity, longitudinally uneven, with cracks and fissures, especially on the edges of the strip, and still other problems.

Until now, these problems have prevented flat rolled products being produced which are both thin and very thin and characterised by a high standard of quality.

This is also due to the need to maintain the basic structure of the rolling line, for reasons of both economics and production, so that it is possible to obtain, on the same rolling line, a relatively wide range of thicknesses as the production cycles are varied.

SUMMARY OF THE INVENTION

In order to overcome these shortcomings, the present applicants have designed and experimentally embodied this invention, adopting a practical solution without excessive installation and maintenance costs but which still guarantees to provide a rolling line able to produce both thin and very thin products either in phase $\gamma$ or in phase $\alpha$, and also those thicknesses which can normally be obtained in conventional rolling lines and which are also rolled either in phase $\gamma$ or phase $\alpha$, and also to obtain further advantages.

The purpose of the invention is to achieve a rolling method, and the relative rolling line, to obtain thin (1.5–3.0 mm) and very thin (about 0.6–0.7 mm and less) flat rolled products, characterised by a very high standard both of the surface and internal quality.

Another purpose of the invention is to achieve a rolling line which is not specifically applied only to these thicknesses, but which will be able to roll alternately, according to the planned cycle of production, both products having the aforesaid thickness and also products with a more conventional thickness, such as for example those in the range of 2.0–12.7 mm and up to 20–25.4 mm.

With the rolling line which achieves the method according to the invention, it is possible, in at least part of the finishing assembly, to roll both in the austenitic field (phase $\gamma$) and in the ferritic field (phase $\alpha$) depending on the final product.

According to a first embodiment of the invention, after the heating and temperature-maintenance furnace, there are one or two roughing or pre-finishing stands.

The slabs produced by the continuous casting machine, according to the invention, are supplied to the heating and temperature-maintenance furnace with a thickness of between 50 and 90 mm.

When the slab is between 50 and 60 mm thick, according to the invention only one roughing or pre-finishing stand is used, while for thicknesses of between 60 and 90 mm normally two or more roughing or pre-finishing stands are used.

Alternatively, there may be a pre-finishing train comprising at least a reversible stand, preceded and followed by hot winding reels, in order to carry out the desired number of pre-finishing passes.

The heating and temperature-maintaining furnace according to the invention is as long as is necessary to contain all the product cast with one ladle, or a slab as long as a desired plurality of coils of the desired product.

According to a variant, upstream of the heating and temperature-maintaining furnace there is an accumulation and heating furnace which makes it possible to feed a cold load, or to contain the slabs cast with one ladle, or to feed thick slabs or slabs with an intermediate thickness of between 80 and 200÷250 mm.

According to a variant, there is a welding system between the slab which is being rolled in the pre-finishing stand and the following slab so as to achieve continuity in the processing.

According to the invention, downstream of the roughing train there is a tunnel furnace to equalise the temperature.

Downstream of the tunnel furnace, according to a first embodiment of the invention, there is a temperature conditioning and adjustment system.

This temperature conditioning and adjustment system takes the bar, which leaves the roughing train with a thickness of between 10 and 50 mm depending on the thickness of the final product, to the desired temperature so that at least part of the finishing rolling takes place in the austenitic or ferritic field according to the chosen field wherein rolling has to proceed.

According to the invention, a thickness of between 10 and 15 mm serves to obtain final thicknesses of between 0.6 and 1.0 mm, whereas a thickness of 15 to 20–25 mm serves to obtain final thicknesses of between 1 to 3 mm.

A thickness of between 20–25 mm and 50 mm serves to obtain final thicknesses of between 3.0 and 25.4 mm.

According to a first variant, all the finishing rolling (that is to say, rolling carried out with the finishing stands) takes place in the austenitic or ferritic field.

The temperature conditioning and adjustment system comprises means for both heating and cooling the bar in a homogeneous manner; this is because it serves to heat the bar to obtain thin strip in the austenitic field, that is to say with the temperatures of the strip at the outlet of the rolling mill above the austenite-ferrite transformation point.

In this way it is possible to produce thicknesses of 0.6 mm even in the austenitic field.

On the contrary, if the bar is to be rolled in the ferritic field it has to be cooled.

The invention includes these heating and/or cooling means, that is to say, means which control the temperature of the bar and are connected with heating-adjustment and/or, respectively, cooling-adjustment means.

After the temperature conditioning and adjustment system, the invention includes from five to seven finishing stands and, downstream thereof, a cooling system, a winding system, and a system to discharge the coils.

In a second variant, the conditioning and adjustment system, that is, the means which control the temperature of the bar, is placed in an intermediate position of the finishing stands.

According to this variant, the conditioning and adjustment system can be put after the first stand, or after one or another of the subsequent stands, provided that there is at least a finishing stand after the conditioning and adjustment system.

In this way, the finishing assembly is divided into two blocks, the first and second finishing blocks.

In the event that only the first block is used, a substantially conventional rolling method is achieved in the austenitic field.

When both blocks are used, the rolling passes in the second block are carried out with the product in the ferritic field (phase $\alpha$).

In this second case, the first block of the finishing train serves to take the thickness of the intermediate product progressively to a value of around 1.0÷1.4 mm, according to the production requirements of the line.

The second block of the finishing train takes the thickness of the product to the final values required, for example 0.6÷1.0 mm, or other thickness close to the desired values.

According to a first embodiment, in the intermediate segment between the first and second block of the finishing train there is at least a cooling system.

The length of the intermediate segment and the intensity of the action of the cooling system are calculated to ensure that, when thin products are produced, the product entering the second finishing block is substantially in the ferritic state $\alpha$.

The inclusion of the intermediate cooling system between the first and second finishing blocks, when thin or very thin products are produced, causes the temperature of the intermediate product to be lowered.

The product, which has been rolled in its austenitic state $\gamma$ in the first reducing passes, is thus taken to its ferritic state $\alpha$ and in this state the product is subjected to the final reducing passes.

According to another embodiment of the invention, in the intermediate segment between the two blocks of the finishing train the product is subjected to a heat treatment which returns it, wholly or almost wholly, to its austenitic state $\gamma$.

In this case, downstream of the second block of the finishing train there is a cooling assembly structured and sized to guarantee the correct cooling of the finished product before it is wound into a coil.

According to the invention, immediately downstream of the finishing assembly there is a coiler assembly, with a single mandrel or a double carousel-type mandrel.

The coiler assembly, which includes by-pass and exclusion means, serves for thin strip, that is to say, up to 3 mm, while for greater thicknesses a traditional method is followed.

The positioning of the coiler immediately after the finishing assembly serves to control the temperature of the strip so that it does not go below the desired values due to radiance.

The coiler assembly is associated with a shears assembly immediately upstream thereof.

Whatever the final thickness desired, the invention makes it possible to roll the product in a heat condition which is far removed from the allotropic transformation step, thus avoiding the aforesaid disadvantages and ensuring better rolling conditions.

When the final thickness required is in the range of 1.0–1.5 mm or more, and rolling is carried out according to traditional techniques, the second block of the finishing train is excluded, the product is already finished when it leaves the reducing passes carried out in the first block and is cooled in a conventional manner by the cooling system downstream of the first block.

According to a variant, downstream of the second block of the finishing train and before the coiler assembly there is a second cooling system, smaller in size, with the purpose of finishing the heat conditions of the product before it is wound into a coil.

According to a variant, rolling in the second block of the finishing train is carried out, with the product in phase α, even of products which are not particularly thin, for example in the range of 2.0–3.0 mm, when it is desired to give the rolled stock particular mechanical characteristics of malleability without subsequent heat treatments.

BRIEF DESCRIPTION OF THE DRAWINGS

The attached Figures are given as a non-restrictive example and show some preferential embodiments of the invention as follows.

DETAILED DESCRIPTION OF THE PREFERRED EMBODIMENTS

The attached Figures show respectively, in an extremely schematic and simplified form, a conventional rolling line 10 for flat products.

Figure 1:
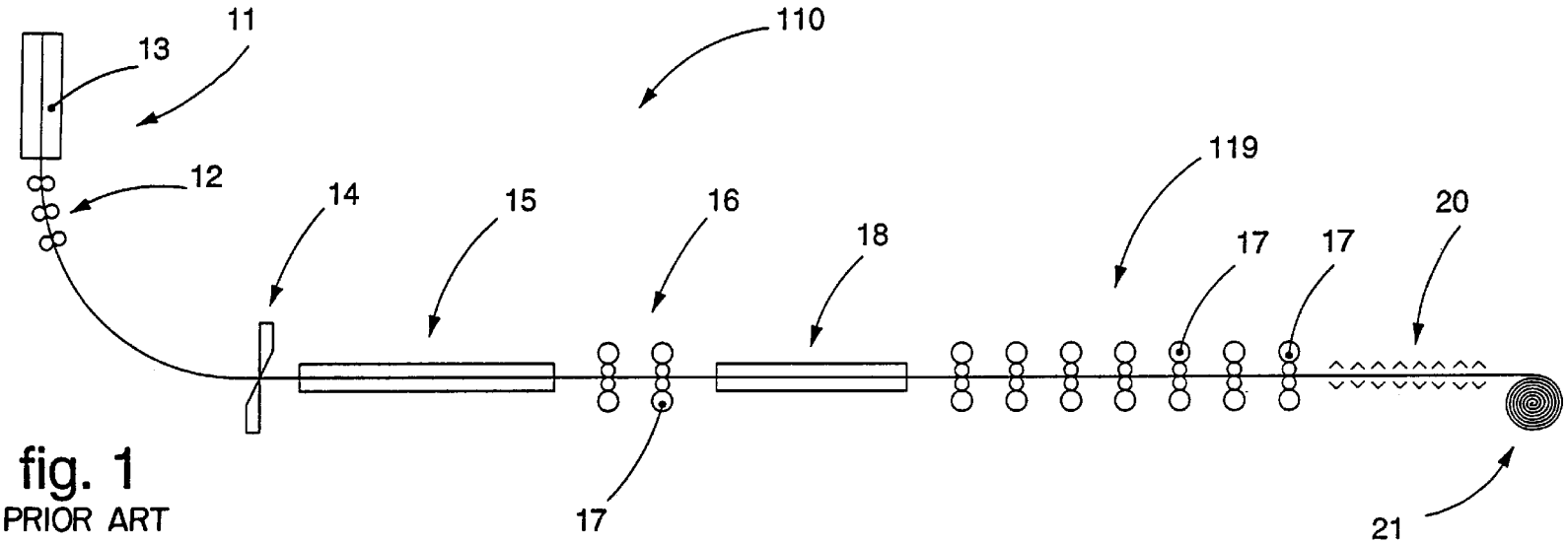
fig. 1 PRIOR ART
FIG. 1 shows schematically a rolling line of a substantially conventional type for flat products.

In FIG. 1, the rolling line 110 is of the conventional type.

Figure 3:
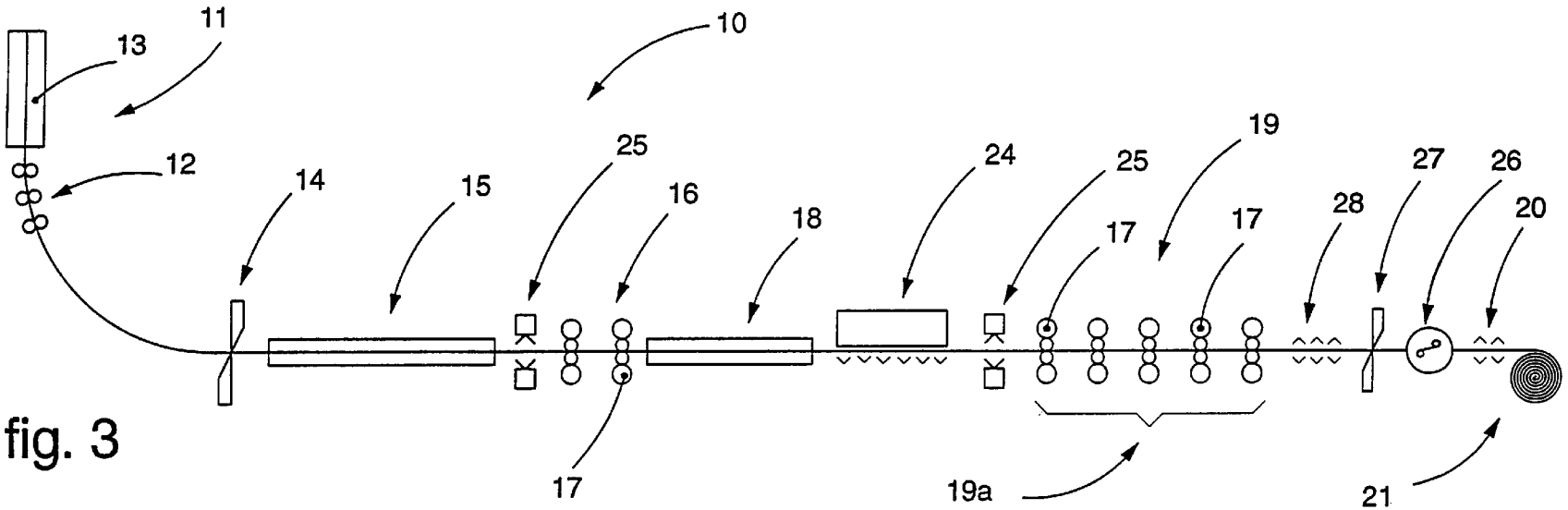
FIG. 3 shows a variant of the embodiment shown in FIG. 2.
Figure 2:
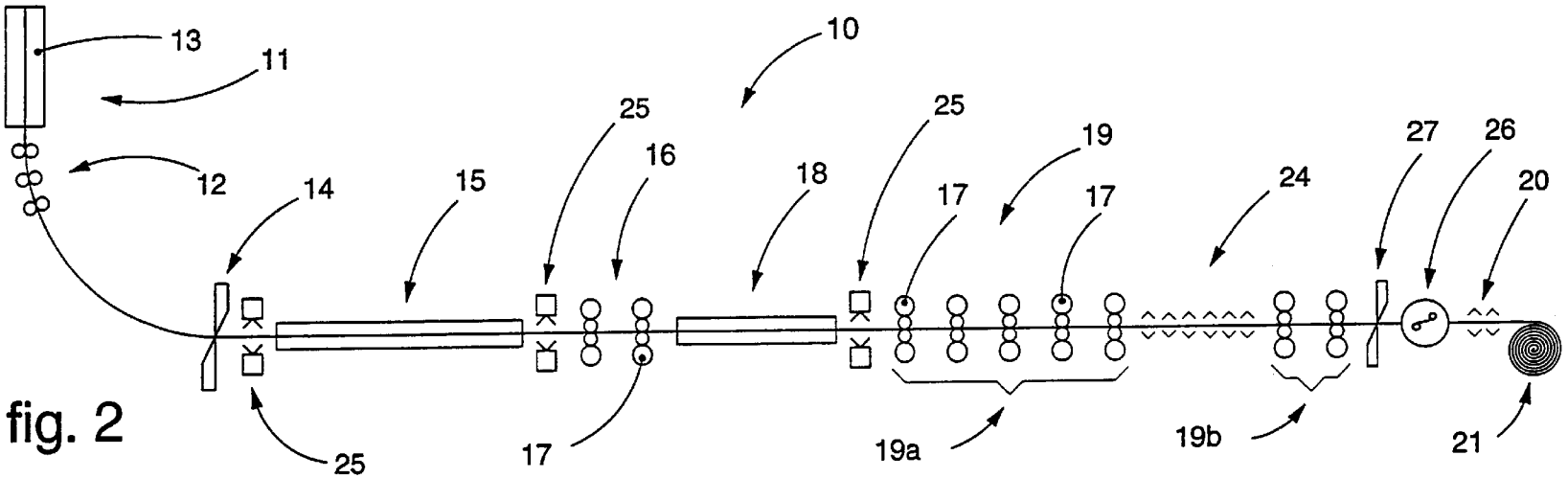
FIG. 2 shows the rolling line of a first embodiment of the invention.

The rolling lines 10 according to the invention as shown in FIGS. 2 and 3 are of the type where rolling is directly connected to the continuous casting machine which in this case is advantageously equipped with a soft-reduction system.

Figure 4:
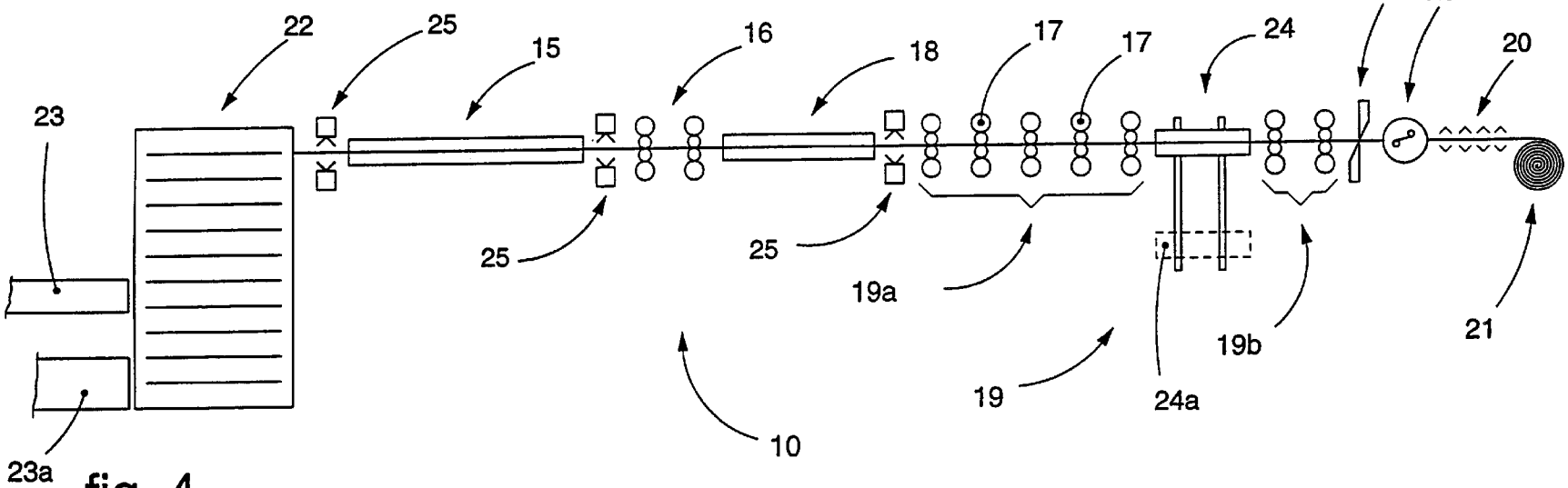
FIG. 4 shows another embodiment of the invention.

The rolling line 10 as shown in FIG. 4 is of the type which includes a furnace 22 to accumulate and heat thick slabs or slabs with an intermediate thickness of between 80 and 200–250 mm, connected at the outlet with the rolling train and connected with the continuous casting machine possibly by a feeder way 23 and with a cold loading system by a feeder way 23*a*.

The continuous casting machine 11 is equipped with soft-reduction devices 12 for the slab leaving the ingot mold 13, followed by a shears 14 and a heating and maintenance furnace 15.

There may possibly be other systems, such as descaling devices or other, before the shears 14.

Between the shears 14 and the furnace 15, and/or between the outlet of the casting machine and the shears 14, according to the invention a descaling system 25 is advantageously included.

At the outlet of the heating and maintenance furnace 15 there is a descaling system 25 followed by a roughing or pre-finishing train 16 comprising, in this case, two stands 17, which achieves a first reduction in the thickness of the cast product.

According to a variant, the roughing train 16 can be of the reversible type and cooperate upstream and downstream with hot winding/unwinding systems such as are known to the state of the art and which are not shown here.

Downstream of the roughing train 16 there is a tunnel furnace system 18, to equalise the temperature, which serves to feed to the finishing train 19, which includes at least three reduction passes, a product with a uniform temperature, both lengthwise and also on the transverse section, and with the correct heat conditions.

Upstream of the finishing train 19 and downstream of the tunnel furnace 18 there is at least a descaling system 25.

In the embodiment shown in FIG. 2, the temperature equalisation system, or tunnel furnace 18, is arranged so that at least the first passes of the finishing train 19 are carried out with the product in its austenitic state γ, thus guaranteeing rolling conditions such as to ensure that a final product is obtained with a high quality, both metallurgical and dimensional.

The finishing train 19 in this case comprises seven rolling stands 17 and is followed by a cooling system 20 and in this case a downcoiler 21 to form the coil.

When rolling thin products, in the order of 0.6–0.7 mm, the final rolling passes in a finishing train 119 of the type shown in FIG. 1 are carried out on a product which is in the area of allotropic transformation from state γ to state α, and this causes considerable problems in the quality of the product and often makes the final product obtained unacceptable.

According to the invention, in the embodiments of FIGS. 2–4 for thicknesses of less than 3.0 mm, immediately at the outlet of the finishing train 19 there is a coiler assembly 26 with the shears assembly 27 upstream; these two assemblies 26 and 27 can be excluded from the line when larger thicknesses are rolled.

The shears assembly 27 and the coiler assembly 26 may be preceded by a fast cooling assembly 28 shown for the sake of simplicity in FIG. 3 only.

The rolling lines 10 as shown in FIGS. 2 and 4 according to the invention include a finishing train 19 structured in two blocks, respectively 19*a* and 19*b*, between which there is a temperature conditioning and adjustment system 24.

In the case shown in FIG. 2, the temperature conditioning and adjustment system 24 consists of a cooling system.

The first block 19*a*, which in this case comprises five rolling stands 17, causes a progressive reduction in thickness which may or may not require further reduction passes in the second block 19*b*.

For example, in the production of products in the range of 1.0–1.5 mm or more, and when rolling is carried out in a substantially conventional manner, the product leaves the first block 19*a* in a finished state, it is cooled in the temperature conditioning and adjustment system 24 and then wound into coils, and the second block 19*b* is operationally excluded from the process.

In the production of thin and very thin products, in the order of 0.6–0.7 mm, the product leaves the five passes made in the first block 19*a* with a thickness of around 1.0–1.4 mm, it is then subjected to cooling in the temperature conditioning and adjustment system 24 which causes the transition from allotropic phase γ to phase α, and then it is finished in the two passes made by the second block 19*b* to take it to the desired final thickness.

Therefore, the passes of final reduction are carried out with the product in the ferritic state α, and therefore in conditions which guarantee that a product is obtained which is characterised by a high standard of quality, both metallurgical and dimensional, so that the product is suitable for pressing applications after a simple pickling treatment.

In some cases, the pickling may even be omitted.

According to a variant, rolling is carried out in the second block 19*b* of the finishing train 19 with the product in its ferritic state α for thicknesses of the order of 2.0–3.0 mm in order to give the rolled stock, even if it is not particularly thin, particular metallurgical and mechanical characteristics. It is evident that the number of passes—five in the first block 19*a* and two in the second block 19*b*—is purely an example, since different combinations can be used according to the size of the product as it enters the finishing train 19, the final thickness to be obtained, the type of material, etc.

In fact, according to the invention, in the case of seven stands the following combinations are possible: 2+5; 1+5 and one disabled; 1+6, etc.

When there is a greater or smaller number of stands, the composition achieved on each occasion will depend on the cycle and the result desired.

According to the invention, the number of reduction passes in the first block 19*a* is between 1 and 7, while the number of reduction passes in the second block 19*b* is 6 at the most.

In the embodiment shown in FIG. 2, downstream of the second block 19*b* there is a further cooling system 20, smaller in size, suitable to complete the heat treatment on the finished product before coiling is carried out downstream.

In the variant shown in FIG. 4, the temperature conditioning system 24 placed between the first block 19*a* and the second block 19*b* of the finishing train 19 also comprises a heating system which can either be excluded from the line so as to assume a position of non-interference 24*a*, or can be temporally switched on or off.

With the heating system switched on, the temperature conditioning and adjustment system 24 acts on the product leaving the first block 19*a* during its allotropic transformation step from state γ to state α, and returns the product to its austenitic state γ, in order to perform the final reduction passes in the second block 19*b* and obtain thin strip even in the austenitic step.

In this embodiment, the second block 19*b* is followed by a cooling system 20 structured and sized to take the finished rolled product to the correct temperature to be wound into a coil.

When strip wound has a thickness of less than 1.0 mm, a coiling assembly 26 is used which is not of a conventional type, for example including a carousel with two winding reels operating alternately, in order to avoid the problems which might arise with a strip of such a reduced thickness entering a conventional downcoiler.

In the embodiment shown in FIG. 3, the temperature conditioning and adjustment system 24 located immediately downstream of the tunnel furnace 18 includes heating and cooling means.

What is claimed is:

1. Rolling method for thin flat products, used in the production of flat rolled products, such as strip or sheet, with a final thickness in the range of 0.6–3.0 mm, in a plant suitable to work thicknesses of up to 25.4 mm, the method being applied to slabs with a thickness of between 50 mm and 90 mm if arriving directly from the continuous casting machine or on slabs with a greater thickness, of between 80 and 250 mm, if fed from a furnace to accumulate and heat the slabs, the method comprising conducting at least a first heat treatment to heat the slabs, then conducting a roughing or pre-finishing pass comprising one or more passes to reduce the thickness of the slabs to provide a reduced thickness product in the austenitic state, then conducting a temperature equalisation treatment, conducting a finishing pass in a finishing train comprising at least three reduction passes, controlling the temperature of the reduced thickness product in a single temperature conditioning and adjustment system either immediately before conducting the finishing pass or at an intermediate position of the finishing train to keep the reduced thickness product in the austenitic state or to transform the reduced thickness product to the ferritic state, conducting a cooling process after the finishing pass to form finished flat product, and winding the finished flat product.

2. Method as in claim 1, in which the step of controlling the temperature of the reduced thickness product is conducted at intermediate position of the finishing train.

3. Method as in claim 1, in which the step of controlling the temperature of the reduced thickness product is conducted upstream of the finishing train.

4. Method as in claim 1, in which the step of controlling the temperature of the reduced thickness product comprises cooling the product to take the whole product, at the inlet to the finishing pass, substantially to a ferritic state α.

5. Method as in claim 1, in which the step of controlling the temperature of the reduced thickness product comprises heating the product to return the whole product, at the inlet to the finishing pass, substantially to an austenitic state α.

6. Method as in claim 1, in which, in the production of flat rolled products with a final thickness of around 0.6–1.0 mm, the product enters the finishing step with a thickness of around 10–15 mm and is previously subjected to a descaling process.

7. Method as in claim 1, in which the finishing pass comprises from three to seven reducing passes.

8. Method as in claim 1, further comprising immediately winding the strip with a thickness of around 0.6–3 mm into a coil after a fast cooling step.

9. Method as in claim 1, further comprising performing a fast cooling treatment downstream of the finishing pass.

10. Method as in claim 1, wherein the roughing or pre-finishing pass comprises a plurality of passes without any heat treatment between passes.

11. Method as in claim 3, in which the finishing pass after the temperature conditioning and adjustment system comprises from one to six reducing passes.

12. Rolling method for thin flat products, used in the production of flat rolled products, such as strip or sheet, with a final thickness in the range of 0.6–3.0 mm, in a plant suitable to work thicknesses of up to 25.4 mm, the method being applied to slabs with a thickness of between 50 mm and 90 mm if arriving directly from the continuous casting machine or on slabs with a greater thickness, of between 80 and 250 mm, if fed from a furnace to accumulate and heat the slabs, the method comprising conducting at least a first heat treatment to heat the slabs, then conducting a roughing or pre-finishing pass comprising one or more passes tor reduce the thickness of the slabs to provide a reduced thickness product in the austenitic state, then conducting a temperature equalisation treatment, conducting a finishing pass in a finishing train comprising at least three reduction passes, controlling the temperature of the reduced thickness product either immediately before conducting the finishing pass or at an intermediate position of the finishing train, to keep the reduced thickness product in the austenitic state or to transform the reduced thickness product to the ferritic state, conducting a cooling process after the finishing pass to form finished flat product, and winding the finished flat product, in which in the production of flat products with a final thickness of above 1.0 mm and up to 3.0 mm, the product enters the finishing pass with a thickness of around 15–25 mm and is previously subjected to a descaling process.

13. Rolling method for thin flat products, used in the production of flat rolled products, such as strip or sheet, with a final thickness in the range of 0.6–3.0 mm, in a plant suitable to work thicknesses of up to 25.4 mm, the method being applied to slabs with a thickness of between 50 mm and 90 mm if arriving directly from the continuous casting machine or on slabs with a greater thickness, of between 80 and 250 mm, if fed from a furnace to accumulate and heat the slabs, the method comprising conducting at least a first heat treatment to heat the slabs, then conducting a roughing or pre-finishing pass comprising one or more passes tor reduce the thickness of the slabs to provide a reduced thickness product in the austenitic state, then conducting a temperature equalisation treatment, conducting a finishing pass in a finishing train comprising at least three reduction passes, controlling the temperature of the reduced thickness product either immediately before conducting the finishing pass or at an intermediate position of the finishing train, to keep the reduced thickness product in the austenitic state or to transform the reduced thickness product to the ferritic state, conducting a cooling process after the finishing pass to form finished flat product, and winding the finished flat product, in which in the production of flat products with a final thickness of from 3.0 to 25.4 mm, the product enters the finishing pass with a thickness of around 25–50 mm and is previously subjected to a descaling process.

14. Rolling line for the production of thin, flat rolled products, such as strip or sheet, used to obtain flat rolled products with a final thickness in the range of 0.6–25.4 mm by rolling slabs with a thickness of between 50 and 90 mm if arriving directly from the continuous casting machine or with a greater thickness, of between 80 and 250 mm, if fed from a furnace to accumulate and heat the slabs, the rolling line comprising a maintenance and heating system, a roughing or pre-finishing train comprising one or more stands, a temperature equalisation system and a finishing train to obtain the final thickness, the finishing train being followed by a cooling system and by a downcoiler assembly, the rolling line being characterised in that the finishing train cooperates with a single temperature conditioning and adjustment system provided either immediately upstream of the finishing train or at an intermediate position between the first and last stand of the finishing train.

15. Rolling line as in claim 14, in which the temperature conditioning and adjustment system is placed immediately upstream of the finishing train.

16. Rolling line as in claim 14, in which the temperature conditioning and adjustment system is placed in an intermediate position between the first and last stand of the finishing train.

17. Rolling line as in claim 14, in which the temperature conditioning and adjustment system includes at least means to heat the intermediate product.

18. Rolling line as in claim 14, in which the temperature conditioning and adjustment system includes at least means to cool the intermediate product.

19. Rolling line as in claim 15, in which there is a descaling assembly provided between the finishing train and the temperature conditioning and adjustment system.

20. Rolling line as in claim 14, in which there is a heating and temperature-equalisation tunnel furnace between the roughing or pre-finishing train and the finishing train.

21. Rolling line as in claim 14, in which the roughing or pre-finishing train comprises one or more stands in sequence.

22. Rolling line as in claim 14, in which the finishing train comprises a first finishing block, the temperature conditioning and adjustment system and a second finishing block.

23. Rolling line as in claim 14, which cooperates with a furnace to accumulate and heat thick slabs with a thickness of up to 250 mm.

24. Rolling line for the production of thin, flat rolled products, such as strip or sheet, used to obtain flat rolled products with a final thickness in the range of 0.6–25.4 mm by rolling slabs with a thickness of between 50 and 90 mm if arriving directly from the continuous casting machine or with a greater thickness, of between 80 and 250 mm, if fed from a furnace to accumulate and heat the slabs, the rolling line comprising a maintenance and heating system, a roughing or pre-finishing train comprising one or more stands, a temperature equalisation system and a finishing train to obtain the final thickness, the finishing train being followed by a cooling system and by a downcoiler assembly, the rolling line being characterised in that the finishing train cooperates with a single temperature conditioning and adjustment system provided either immediately upstream of the finishing train or at an intermediate position between the first and last stand of the finishing train, in which immediately downstream of the finishing train there is a coiler assembly for thin products preceded by a shears and a system of rapid cooling.

25. Rolling line as in claim 4, wherein the roughing or pre-finishing train comprises a plurality of stands without any heating unit between stands.

26. Rolling line as in claim 24, wherein the roughing or pre-finishing train comprises a plurality of stands without any heating unit between stands.

* * * * *